US007806123B2

(12) United States Patent
Mehio

(10) Patent No.: US 7,806,123 B2
(45) Date of Patent: Oct. 5, 2010

(54) MODULAR SMOKING APPARATUS

(75) Inventor: Nizar Youssef Mehio, Tallet El Khayet (LB)

(73) Assignee: Mya Saray, LLC, Sterling, VA (US)

( * ) Notice: Subject to any disclaimer, the term of this patent is extended or adjusted under 35 U.S.C. 154(b) by 1817 days.

(21) Appl. No.: 10/751,119

(22) Filed: Jan. 5, 2004

(65) Prior Publication Data

US 2004/0163658 A1 Aug. 26, 2004

(30) Foreign Application Priority Data

Jan. 31, 2003 (LB) ..... 6657

(51) Int. Cl.
*A24F 1/14* (2006.01)
*A24F 1/30* (2006.01)

(52) U.S. Cl. ..... 131/173; 131/221; 131/229; 131/201; 131/207

(58) Field of Classification Search ..... 131/173
See application file for complete search history.

(56) References Cited

U.S. PATENT DOCUMENTS 722,405 A * 3/1903 Ganim ..... 131/173
1,513,147 A * 10/1924 Zahariadis ..... 131/173
1,579,703 A * 4/1926 Grant ..... 131/173
3,451,785 A * 6/1969 Marwil et al. ..... 422/113
3,872,872 A * 3/1975 Kahler ..... 131/173

* cited by examiner

*Primary Examiner*—Philip C Tucker
*Assistant Examiner*—Phu H Nguyen
(74) *Attorney, Agent, or Firm*—General Counsel, P.C.

(57) ABSTRACT

A modular smoking apparatus includes a plenum having a substantially vertical dry smoke aperture and a wet smoke aperture disposed substantially parallel to the dry smoke aperture. An upper end of a down tube may be inserted into a lower end of the dry smoke aperture and a lower end of an intermediate tube may be inserted into an upper end of the dry smoke aperture. An upper end of the intermediate tube may be inserted into a the lower end of a burner. A lower end of the plenum may be inserted into an upper end of the base. The base may contain a fluid submerging a lower end of the down tube. The intermediate tube, the dry smoke aperture, and the down tube may form a conduit for dry smoke from the burner to the base, and the wet smoke aperture may form a conduit for wet smoke from the base to a hose.

8 Claims, 5 Drawing Sheets

MODULAR SMOKING APPARATUS

BACKGROUND OF THE INVENTION

1. Field of the Invention

The invention relates to smoking, such as by smoking a pipe, and more particularly to smoking pipes that may be dismantled for repair, replacement, and maintenance.

2. Description of the Related Art

Pipes are often used to smoke substances such as tobacco. Moisture from a fluid may be mixed with pipe smoke to ameliorate harshness and to impart a pleasant flavor or aroma to the smoke. So-called Hubble-Bubble or hookah pipes are one way in which smoke may be mixed with moisture.

A hookah has a bowl or base which is filled with fluid. The base has an opening at the top fitted for a plenum, which is part of a stem. The stem may be a tube conveying smoke from a burner on top to a passage through the plenum, and then through a tube at the bottom of the plenum in to the fluid filling the base. The smoke is let out underneath the surface of the fluid and allowed to bubble up through the fluid to the surface, absorbing moisture as it does. A second passage through the plenum the plenum conveys the now-moistened smoke out of the base to a hose. A smoker smokes the hookah by drawing smoke through the hose.

The base of a hookah may be made of glass, such as crystal. The plenum and stemp stem may be made of metal. There may be an interference fit between the plenum and the base to retain the plenum in the base. A smoker who wishes to move the hookah may grasp the stem and pick up the hookah. An interference fit between the metal and glass may be inadequate to support the weight of the base, particularly if the base is relatively full of fluid. The base may consequently fall off while the hookah is being carried, possibly sustaining damage.

Stems are often formed of one piece. Since a stem may be relatively long, a one-piece stem may be difficult to clean. The down tube, which runs downward from the plenum to the fluid, may become fouled relatively quickly, since the down tube is in a hot, corrosive, acidic environment formed by the smoke mixing with the fluid in the base. The down tube may be so fouled as to be corroded or occluded. A stem with a corroded or occluded down tube may be difficult to smoke. The entire stem may have to be thrown away when the down tube has become corroded or occluded.

Stems formed of more than one piece may be fitted together with inference fits as well. The interference fits may be secured by wrapping the male component with cloth or masking tape before insertion in the female part. Cloth or masking tape may degrade relatively quickly, however, in the smoky environment.

SUMMARY OF THE INVENTION

A primary object of the invention is to overcome the deficiencies of the related art described above by providing a modular smoking apparatus and a method for using the same. The present invention achieves these objects and others by providing a modular smoking apparatus and a method for using the same.

In a first aspect, a modular smoking apparatus includes a plenum having a substantially vertical dry smoke aperture and a wet smoke aperture disposed substantially parallel to the dry smoke aperture, a down tube having an upper end disposed insertably in a lower end of the dry smoke aperture, an intermediate tube having a lower end disposed insertably in an upper end of the dry smoke aperture, a burner having a lower end, an upper end of the intermediate tube disposed insertably in the lower end of the burner, a base having an upper end, a lower end of the plenum disposed threadably in the upper end of the base, the base containing a fluid, a lower end of the down tube submerged substantially in the fluid, the intermediate tube, the dry smoke aperture, and the down tube forming a conduit for dry smoke from the burner to the base, and the wet smoke aperture forming a conduit for wet smoke from the base to a hose.

In a second aspect, a method for using a modular smoking apparatus includes providing a plenum having a substantially vertical dry smoke aperture and a wet smoke aperture disposed substantially parallel to the dry smoke aperture, inserting an upper end of a down tube into a lower end of the dry smoke aperture, inserting a lower end of an intermediate tube into an upper end of the dry smoke aperture, inserting an upper end of the intermediate tube into a lower end of a burner, filling a base with a fluid, submerging substantially a lower end of the down tube in the fluid, screwing a lower end of the plenum into an upper end of the base, attaching a hose to an upper end of the wet smoke aperture, conducting substantially dry smoke from the burner through the intermediate tube, the dry smoke aperture, and the down tube to the fluid, and conducting substantially wet smoke from the base through the wet smoke aperture to the hose.

In a third aspect, a method for using a modular smoking apparatus may include providing a plenum having a substantially vertical dry smoke aperture and a wet smoke aperture disposed substantially parallel to the dry smoke aperture, inserting an upper end of a down tube into a lower end of the dry smoke aperture, inserting a lower end of a lower cap into an upper end of the dry smoke aperture, inserting a lower end of an intermediate tube into an upper end of the lower cap, inserting an upper end of the intermediate tube into a lower end of an upper cap, inserting an upper end of the upper cap into a lower end of a burner, filling a base with a fluid, submerging substantially a lower end of the down tube in the fluid, screwing a lower end of the plenum into an upper end of the base, attaching a hose to an upper end of the wet smoke aperture, conducting substantially dry smoke from the burner through the intermediate tube, the dry smoke aperture, and the down tube to the fluid, and conducting substantially wet smoke from the base through the wet smoke aperture to the hose.

In a fourth aspect, a system for modular smoking includes a plenum having a substantially vertical dry smoke aperture and a wet smoke aperture disposed substantially parallel to the dry smoke aperture, means for inserting an upper end of a down tube into a lower end of the dry smoke aperture, means for inserting a lower end of an intermediate tube into an upper end of the dry smoke aperture, means for inserting an upper end of the intermediate tube into a lower end of a burner, means for filling a base with a fluid, means for submerging substantially a lower end of the down tube in the fluid, means for screwing a lower end of the plenum into an upper end of the base, means for attaching a hose to an upper end of the wet smoke aperture, means for conducting substantially dry smoke from the burner through the intermediate tube, the dry smoke aperture, and the down tube to the fluid, and means for conducting substantially wet smoke from the base through the wet smoke aperture to the hose.

The above and other features and advantages of the present invention, as well as the structure and operation of various embodiments of the present invention, are described in detail below with reference to the accompanying drawings.

BRIEF DESCRIPTION OF THE SEVERAL VIEWS OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Since a base may fall off a stem while a hookah is being carried by the stem, it would be desirable if the base could fastened securely to the stem. Since a one-piece stem may be difficult to clean, it would be desirable for the stem to be formed of several individual components. Since the down tube of a stem may become corroded or occluded by the atmosphere in the base, it would be desirable for the down tube to be replaceable.

Figures 1, 2:
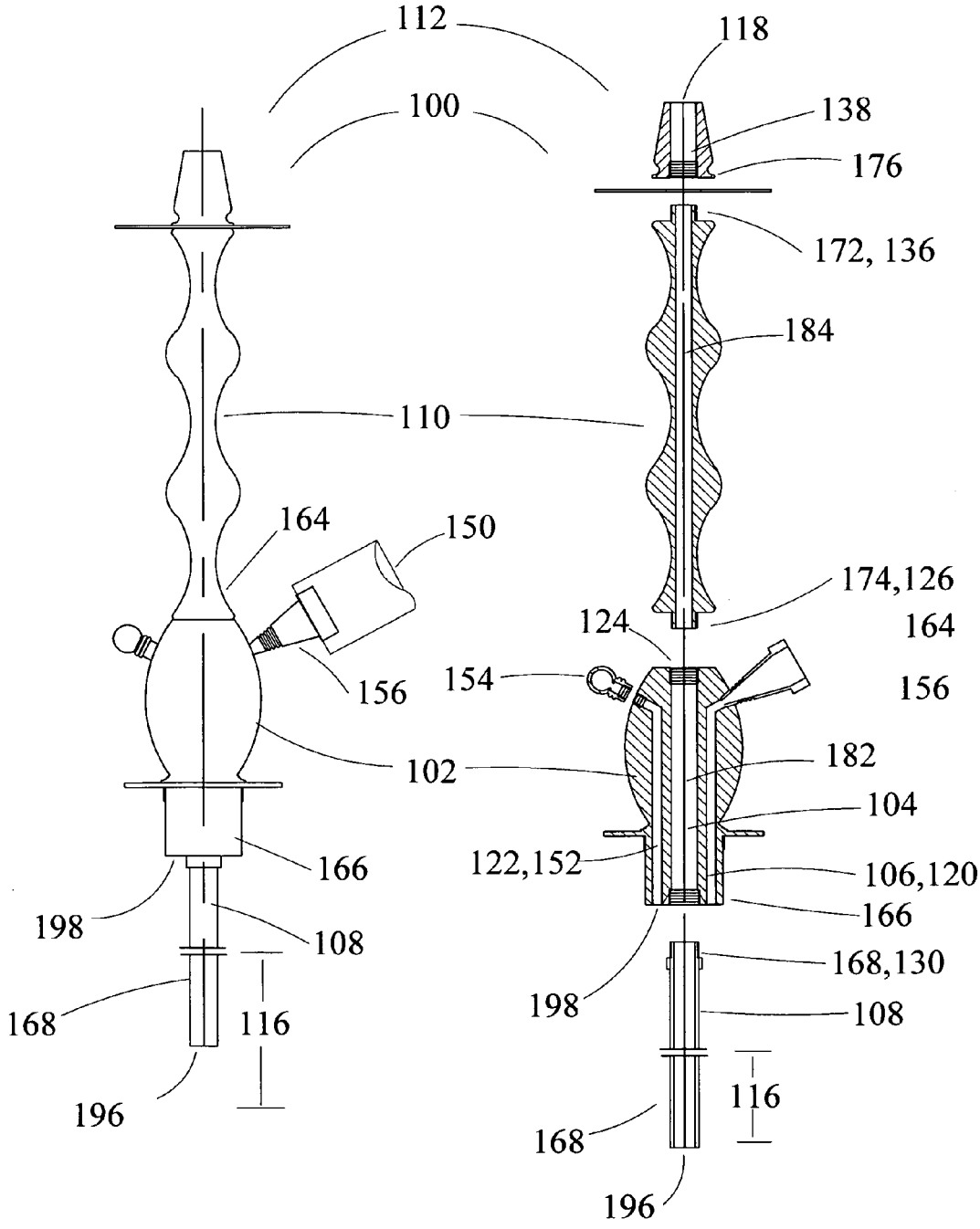
FIG. 1 shows a plan view of a modular smoking apparatus according to a first embodiment of the invention.
FIG. 2 shows an exploded, cut-away view of the embodiment shown in FIG. 1.

FIGS. 1 and 2 show a modular smoking apparatus 100 according to a first embodiment of the invention. Modular smoking apparatus 100 may include a plenum 102. Plenum 102 may have a substantially vertical dry smoke aperture 104 and a wet smoke aperture 106 disposed substantially parallel to dry smoke aperture 104.

An upper end 168 of a down tube 108 may be inserted in a lower end 166 of dry smoke aperture 104. In one embodiment, a lower internal dry smoke aperture thread 128 may be disposed substantially helically within lower end 166 of dry smoke aperture 104 about an axis 182 of dry smoke aperture 104, while an external down tube thread 130 is disposed substantially helically around upper end 168 of down tube 108 about axis 182. In this embodiment, external down tube thread 130 may be disposed threadably in lower internal dry smoke aperture thread 128.

A lower end 174 of an intermediate tube 110 may be inserted in an upper end 164 of dry smoke aperture 104. In one embodiment, an upper internal dry smoke aperture thread 124 may be disposed substantially helically within upper end 164 of dry smoke aperture 104 about an axis 182 of dry smoke aperture 104, while a lower external intermediate tube thread 126 is disposed substantially helically around lower end 174 of intermediate tube 110 about axis 182. In this embodiment, lower external intermediate tube thread 126 may be disposed threadably in upper internal dry smoke aperture thread 124.

Modular smoking apparatus 100 may also include a burner 112 having a lower end 176 into which an upper end 172 of intermediate tube 110 may be inserted. In one embodiment, an upper external intermediate tube thread 136 may be disposed substantially helically around an upper end 172 of intermediate tube 110 about an axis 184 of intermediate tube 110, while an internal burner thread 138 is disposed substantially helically within lower end 176 of burner 112 about axis 184. In this embodiment, upper external intermediate tube thread 136 may be disposed threadably in internal burner thread 138.

In one embodiment, axes 182 and 184 are co-axial. In another embodiment, axes 182 and 184 are skewed relative to each other. This may be the case if modular smoking apparatus 100 is curved. Furthermore, intermediate tube 110 itself may be curved, and axis 184 may be an axis local to lower end 176 or upper end 172. In one embodiment, burner 112, intermediate tube 110, and plenum 102 comprise a stem.

Figure 6:
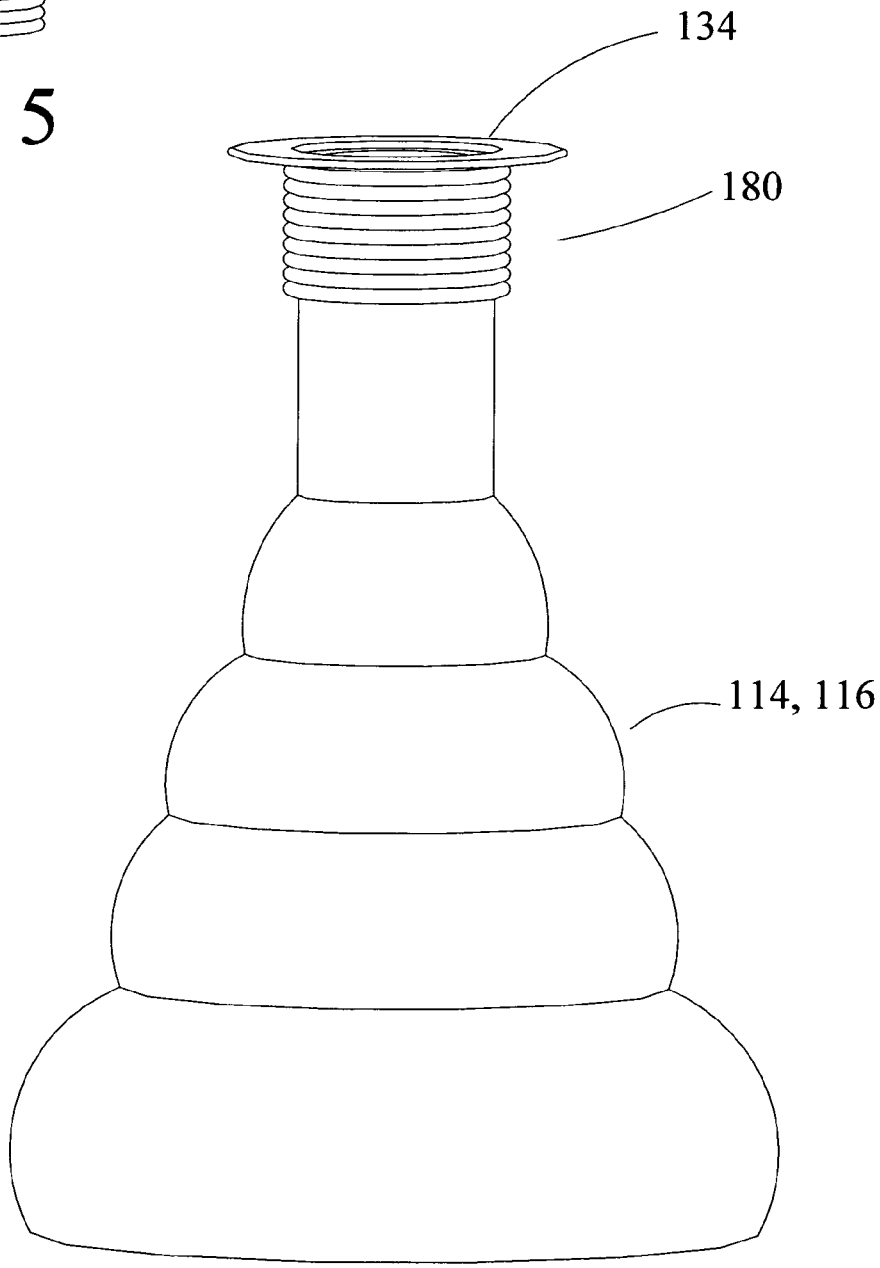
FIG. 6 shows a base for use with an embodiment of the invention.
Figure 7:
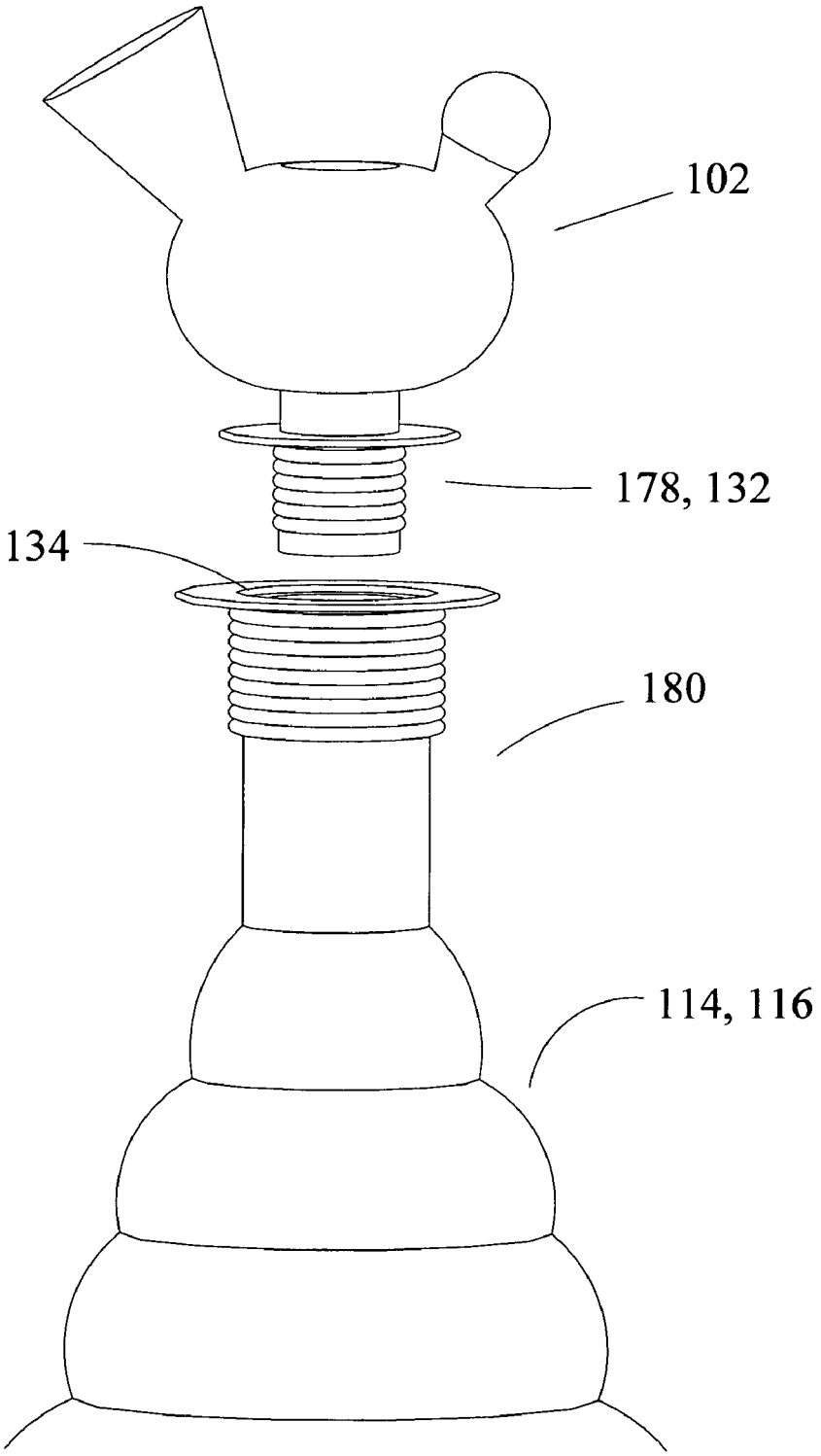
FIG. 7 shows a base and a plenum for use with an embodiment of the invention being assembled.

Modular smoking apparatus 100 may also include a base 114 such as that shown in FIG. 6. Base 114 may have an upper end 180 into which a lower end 178 of plenum 102 may be inserted, as shown in FIG. 7. In one embodiment, lower end 178 is threaded into upper end 180. In this embodiment, an external plenum thread 132 may be disposed substantially helically around lower end of plenum 102 about an axis 182 of dry smoke aperture 104, while an upper internal base thread 134 is disposed substantially helically within upper end 180 of base 114 about axis 182. In this embodiment, external plenum thread 132 may be disposed threadably in upper internal base thread 134.

Figure 5:
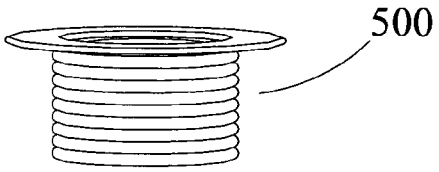
FIG. 5 shows a sleeve for use with an embodiment of the invention.

In one embodiment, upper internal base thread 134 may be disposed substantially helically within a sleeve 500 such as that shown in FIG. 5. Sleeve 500 may be comprised of a metal similar to or compatible with that of external plenum thread 132. Sleeve 500 may be adhered to upper end 180 of base 114 with an adhesive.

In another embodiment, sleeve 500 may be a drawn or spun metal cylinder conforming substantially to upper internal base thread 134. In this embodiment, sleeve 500 may be threaded into upper internal base thread 134.

In several embodiments, base 114 may be made of a material selected from the group consisting of acrylic, glass, Formica, quartz, plastic, and crystal. Base 114 may contain a fluid 116, such as an ethyl-alcohol-based fluid, such as those that may be derived by fermentation or distillation of fruit, grain, or vegetables, or a flavored water such as rose water. In one embodiment, base 114 holds enough fluid 116 to submerge substantially a lower end 168 of down tube 108 when plenum 102 is inserted into base 114.

In one embodiment, intermediate tube 110, dry smoke aperture 104, and down tube 108 form a conduit 118 through which dry smoke 196 may travel from burner 112 to base 114. If lower end 168 of down tube 108 is submerged in fluid 116, dry smoke 196 may absorb moisture from fluid 116 after leaving lower end 168 and become substantially wet smoke 198 as it bubbles to a surface of fluid 116. In one embodiment, wet smoke aperture 106 forms a conduit 120 through which wet smoke 198 may travel from base 114 to a hose 150, after picking up moisture from fluid 116.

In one embodiment, a pressure relief aperture 152 may be disposed in plenum 102 substantially parallel to dry smoke aperture 104 and wet smoke aperture 106. In this embodiment, pressure relief aperture 152 may form a second conduit 122 for wet smoke 198 from base 114 to a pressure relief valve 154.

In one embodiment, modular smoking apparatus 100 may include a fitting 156 for a hose 150 disposed substantially communicably at an end of wet smoke aperture 106. In this embodiment, fitting 156 may attach hose 150 to plenum 102.

Figure 3:
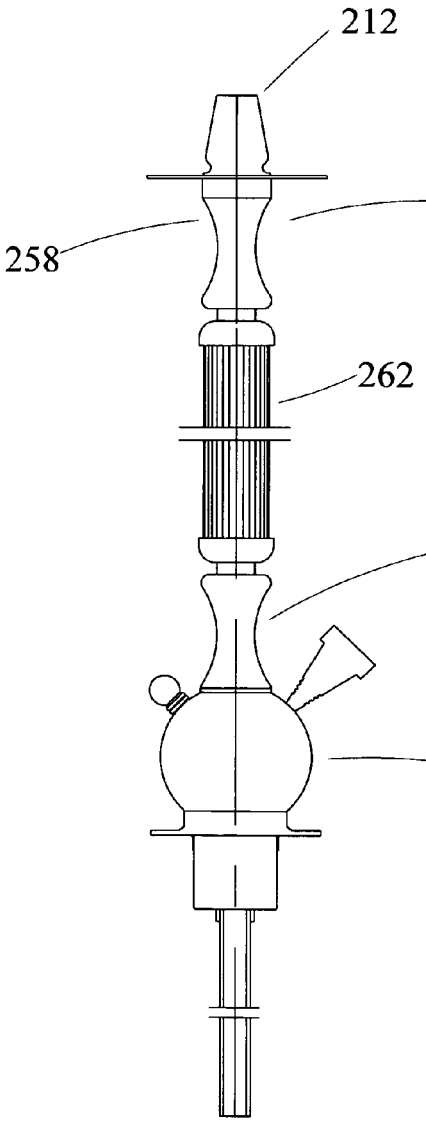
FIG. 3 shows a plan view of a modular smoking apparatus according to a second embodiment of the invention.
Figure 4:
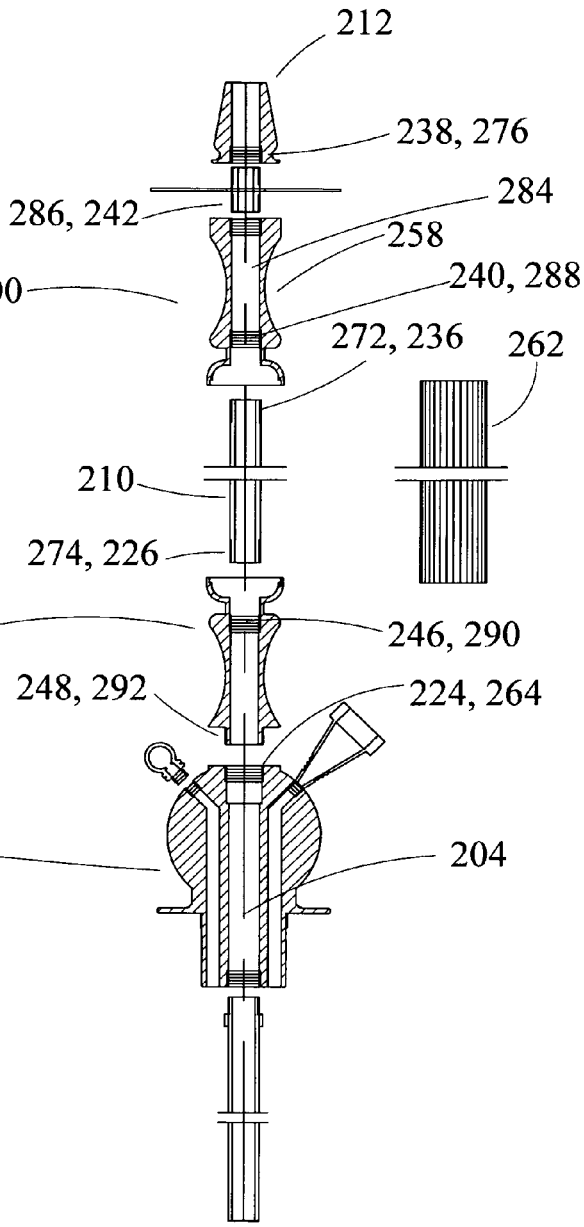
FIG. 4 shows an exploded, cut-away view of the embodiment shown in FIG. 3.

In FIGS. 3 and 4 is shown a modular smoking apparatus 200 according to a second embodiment of the invention. Modular smoking apparatus 200 may include an upper cap 258 placed on an upper end 272 of an intermediate tube 210, between upper end 272 and a burner 212. In one embodiment, upper cap 258 may have an internal upper cap thread 240 disposed substantially helically within a lower end 288 of upper cap 258 about an axis 284 of intermediate tube 210, while an upper external intermediate tube thread 236 is disposed substantially helically around an upper end 272 of intermediate tube 210 about axis 284. In this embodiment, upper external intermediate tube thread 236 may be disposed threadably in internal upper cap thread 240.

In one embodiment, an internal burner thread 238 may be disposed substantially helically within a lower end 276 of burner 212 about axis 284 while an external upper cap thread 242 is disposed substantially helically around an upper end 286 of upper cap 258 about axis 284. In this embodiment, external upper cap thread 242 may be disposed threadably in internal burner thread 238.

Modular smoking apparatus 200 may also include a lower cap 260 placed on a lower end 274 of intermediate tube 210, between lower end 274 and a plenum 202. In one embodiment, lower cap 260 may have an internal lower cap thread 246 disposed substantially helically within an upper end 290 of lower cap 260 about axis 284 of intermediate tube 210, while a lower external intermediate tube thread 226 is disposed substantially helically around lower end 274 of intermediate tube 210 about axis 284. In this embodiment, lower external intermediate tube thread 226 may be disposed threadably in internal lower cap thread 246.

In one embodiment, lower cap 260 may have an external lower cap thread 248 disposed substantially helically around a lower end 292 of lower cap 260 about axis 284, while an upper internal dry smoke aperture thread 224 is disposed substantially helically within an upper end 264 of dry smoke aperture 204 about axis 284. In this embodiment, external lower cap thread 248 may be disposed threadably in upper internal dry smoke aperture thread 224.

In one embodiment, burner 212, upper cap 258, intermediate tube 210, lower cap 260, and plenum 202 comprise a stemp.

In a third embodiment, also shown in FIGS. 3 and 4, modular smoking apparatus 200 may include a cover 262 disposed substantially co-axially with axis 284 of intermediate tube 210 around intermediate tube 210. In this embodiment, burner 212, intermediate tube 210, cover 262, and plenum 202 comprise a stem.

In a third embodiment, a method for using a modular smoking apparatus may include the steps of providing plenum 102 having substantially vertical dry smoke aperture 104 and wet smoke aperture 106 disposed substantially parallel to dry smoke aperture 104, inserting upper end 168 of down tube 108 into lower end 166 of dry smoke aperture 104, inserting lower end 174 of intermediate tube 110 into upper end 164 of dry smoke aperture 104, inserting upper end 172 of intermediate tube 110 into lower end 176 of burner 112, filling base 114 with fluid 116, submerging substantially lower end 170 of down tube 108 in fluid 116, screwing lower end 178 of plenum 102 into upper end 180 of base 114, attaching hose 150 to upper end 194 of wet smoke aperture 106, conducting substantially dry smoke 196 from burner 112 through intermediate tube 110, dry smoke aperture 104, and down tube 108 to fluid 116, and conducting substantially wet smoke 198 from base 114 through wet smoke aperture 106 to hose 150.

In one embodiment, upper end 168 of down tube 108 may be inserted into lower end 166 of dry smoke aperture 104 by screwing. In one embodiment, lower end 174 of intermediate tube 110 may be inserted into upper end 164 of dry smoke aperture 104 by screwing. In one embodiment, upper end 172 of intermediate tube 110 may be inserted into lower end 176 of a burner 112 by screwing.

In a fourth embodiment, a method for using a modular smoking apparatus may include the steps of providing plenum 202 having substantially vertical dry smoke aperture 204 and wet smoke aperture 206 disposed substantially parallel to dry smoke aperture 204, inserting upper end 268 of down tube 208 into lower end 266 of dry smoke aperture 204, inserting lower end 292 of lower cap 260 into upper end 264 of dry smoke aperture 204, inserting lower end 274 of intermediate tube 210 into upper end 290 of lower cap 260, inserting upper end 272 of intermediate tube 210 into lower end 288 of upper cap 258, inserting upper end 286 of upper cap 258 into lower end 276 of a burner 212, filling a base 214 with a fluid 216, submerging substantially a lower end 270 of down tube 208 in fluid 216, screwing a lower end 278 of plenum 202 into an upper end 280 of base 214, attaching a hose 250 to an upper end 294 of wet smoke aperture 206, conducting substantially dry smoke 296 from burner 212 through intermediate tube 210, dry smoke aperture 204, and down tube 208 to fluid 216, and conducting substantially wet smoke 298 from base 214 through wet smoke aperture 206 to hose 250.

In one embodiment, lower end 292 of lower cap 260 may be inserted into upper end 264 of dry smoke aperture 204 by screwing. In one embodiment, lower end 274 of intermediate tube 210 may be inserted into upper end 290 of lower cap 260 by screwing. In one embodiment, upper end 272 of intermediate tube 210 may be inserted into lower end 288 of upper cap 258 by screwing. In one embodiment, upper end 286 of upper cap 258 may be inserted into lower end 276 of a burner 212 by screwing.

Figure 8:
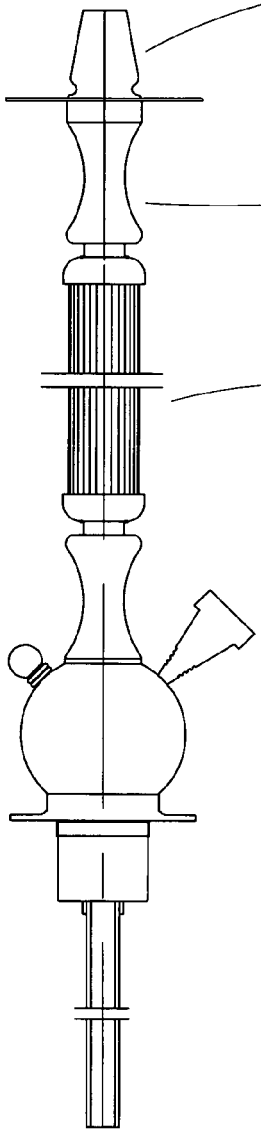
FIG. 8 shows a plan view of a modular smoking apparatus according to a fifth embodiment of the invention.
Figure 9:
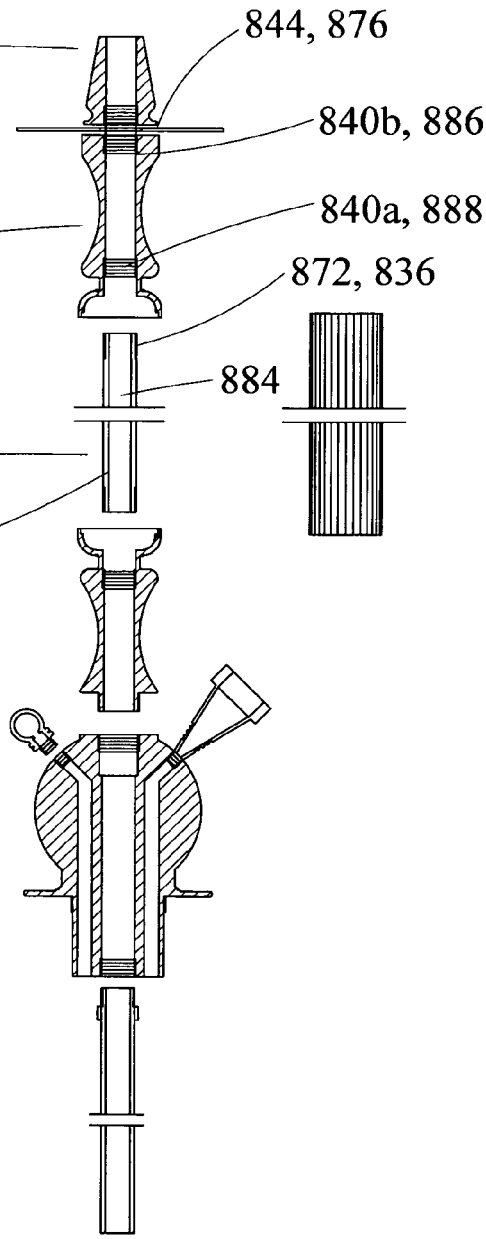
FIG. 9 shows an exploded, cut-away view of the embodiment shown in FIG. 8.

In FIGS. 8 and 9 is shown a modular smoking apparatus 800 according to a fifth embodiment of the invention. Modular smoking apparatus 800 may include an upper cap 858 placed on an upper end 872 of an intermediate tube 810, between upper end 872 and a burner 812. In one embodiment, a first internal upper cap thread **840*a* may be disposed substantially helically within a lower end 888 of upper cap 858 about an axis 884 of intermediate tube 810, while an upper external intermediate tube thread 836 is disposed substantially helically around upper end 872 of intermediate tube 810 about axis 884. In this embodiment, upper external intermediate tube thread 836 may be disposed threadably in first internal upper cap thread 840*a***.

In one embodiment, a second internal upper cap thread **840*b* may be disposed substantially helically within an upper end 886 of upper cap 858 about axis 884, while an external burner thread 844 is disposed substantially helically around a lower end 876 of burner 812 about axis 884. In this embodiment, external burner thread 844 may be disposed threadably in second internal upper cap thread 840*b***.

The foregoing has described the principles, embodiments, and modes of operation of the present invention. However, the invention should not be construed as being limited to the particular embodiments described above, as they should be regarded as being illustrative and not restrictive. It should be appreciated that variations may be made in those embodiments by those skilled in the art without departing from the scope of the present invention.

While various embodiments of the present invention have been described above, they should be understood to have been presented by way of examples only, and not limitation. Thus, the breadth and scope of the present invention should not be limited by the above described embodiments.

Obviously, numerous modifications and variations of the present invention are possible in light of the above teachings. It is therefore to be understood that the invention may be practiced otherwise than as specifically described herein.

What is claimed is:

1. A modular hookah comprising:

a base, dimensioned to contain a substantial amount of fluid, with an internally threaded upper end for receiving dry smoke; and a stem, with an intermediate tube, having an upper end and a lower end, defining a dry smoke aperture; and a plenum further defining said dry smoke aperture and defining a wet smoke aperture oriented to accept wet smoke from said base, said plenum having an upper end adapted to removably fasten to said lower end of said intermediate tube and an externally threaded lower end configured to mate with said threaded upper end of said base, and wherein said stem terminates in a selectively releasable peripheral down tube, defining said dry smoke aperture and dimensioned to substantially penetrate said base, and with an upper end adapted to removably fasten to said plenum.

2. The modular hookah of claim 1 further comprising an intermediate tube upper cap in releasable attachment to both said intermediate tube and a burner.

3. The modular hookah of claim 2 further comprising an intermediate tube lower cap in releasable attachment to both said intermediate tube and said plenum.

4. The modular hookah of claim 3 further comprising an intermediate tube cover dimensioned to house said intermediate tube.

5. The modular hookah of claim 1 wherein said intermediate tube is adapted to threadably fasten to said plenum and said plenum is adapted to threadably fasten with both said down tube and said base.

6. The modular hookah of claim 5 further comprising a burner adapted to removably fasten to said intermediate tube.

7. The modular hookah of claim 6 wherein said burner is adapted to threadably fasten to said intermediate tube.

8. A modular hookah comprising:

a base, dimensioned to contain a substantial amount of fluid, with a threaded upper end for receiving dry smoke; and a stem, having a threaded lower end configured to mate with said threaded upper end of said base, terminating in a selectively releasable peripheral down tube dimensioned to substantially penetrate said base, said stem defining a dry smoke aperture oriented to conduct dry smoke into said base and a wet smoke aperture oriented to accept wet smoke from said base, and wherein said stem further defines a pressure release aperture selectively obstructed by a pressure release valve, and wherein said pressure release valve includes a threaded connection for releasably affixing to said stem.

* * * * *